US007640953B2

(12) United States Patent
Ansaloni

(10) Patent No.: US 7,640,953 B2
(45) Date of Patent: Jan. 5, 2010

(54) MACHINE FOR FILLING CAPSULES WITH A PRODUCT

(75) Inventor: Angelo Ansaloni, Crespellano (IT)

(73) Assignee: MG 2 - S.r.l., Pianoro (IT)

( * ) Notice: Subject to any disclaimer, the term of this patent is extended or adjusted under 35 U.S.C. 154(b) by 357 days.

(21) Appl. No.: 11/644,409

(22) Filed: Dec. 22, 2006

(65) Prior Publication Data

US 2007/0169839 A1 Jul. 26, 2007

(30) Foreign Application Priority Data

Dec. 29, 2005 (EP) ..... 05425934

(51) Int. Cl.
*B65B 43/42* (2006.01)

(52) U.S. Cl. ..... 141/147; 141/144; 141/145; 141/146

(58) Field of Classification Search ..... 141/69, 141/71, 144–150, 284; 222/168.5
See application file for complete search history.

(56) References Cited

U.S. PATENT DOCUMENTS 3,847,191 A * 11/1974 Aronson ..... 141/12
3,893,492 A * 7/1975 Nohren ..... 141/1
4,062,386 A * 12/1977 Zanasi ..... 141/258
4,343,130 A 8/1982 Facchini
5,287,897 A * 2/1994 Gamberini ..... 141/130
5,626,171 A * 5/1997 Mirri ..... 141/152
6,327,835 B1 * 12/2001 Trebbi ..... 53/53
6,390,330 B2 * 5/2002 Runft ..... 222/41
6,886,612 B2 * 5/2005 Duffield ..... 141/284
7,051,771 B2 * 5/2006 Ede et al. ..... 141/71
7,449,342 B2 * 11/2008 Kane et al. ..... 436/180

* cited by examiner

*Primary Examiner*—Timothy L Maust
(74) *Attorney, Agent, or Firm*—Gottlieb, Rackman & Reisman

(57) ABSTRACT

In a continuous machine for filling containers with a product, each container is fed along a given path in time with a relative metering device, which withdraws the product from a tank, feeds the withdrawn product into the container, and has a piston moved with respect to a cylinder by an actuating device having a tappet, which is carried by the piston and maintained contacting a cam by a pneumatic push assembly.

15 Claims, 5 Drawing Sheets

MACHINE FOR FILLING CAPSULES WITH A PRODUCT

The present invention relates to a machine for filling containers with a product.

More specifically, the present invention relates to a machine for filling capsules with a powdered pharmaceutical product, to which the following description refers purely by way of example.

BACKGROUND OF THE INVENTION

In the pharmaceutical industry, a machine for filling capsules with a powdered pharmaceutical product is known comprising a conveying device, which is movable continuously along a given path and has a number of pockets, each for receiving a respective bottom shell of a relative capsule; a container containing the product; and a metering wheel mounted to rotate continuously about a respective longitudinal axis.

The metering wheel has a number of metering devices, each of which is movable with the metering wheel along a portion of said path, in time with a relative bottom shell, to withdraw the product from said container and feed the product into the bottom shell, and comprises a cylinder and a piston moving vertically with respect to each other.

The cylinder and piston are moved with respect to each other by respective actuating devices, each of which comprises at least one cam located over said container, and at least one tappet cooperating with the cam. The piston actuating device also comprises at least one spring fitted to the piston and interposed between the piston and the cylinder to keep the relative tappet normally in contact with the relative cam.

At the end of each operating cycle of the machine, the powdered pharmaceutical product scattered about the metering wheel must be stabilized to prevent it being inhaled by machine maintenance and cleaning personnel.

Since the product is stabilized by spraying water on the metering wheel and, therefore, on the actuating devices, known machines of the above type have several drawbacks, mainly due to the fact that, to prevent corrosion and rusting, the cams, tappets, and springs of the metering devices must be made of stainless steel, have a relatively short working life, and require frequent maintenance.

Another drawback of known machines of the above type lies in the presence and size of the cams seriously impairing the effectiveness of the product stabilizing and machine washing operations.

SUMMARY OF THE INVENTION

It is an object of the present invention to provide a machine for filling capsules with a product, designed to eliminate the aforementioned drawbacks.

According to the present invention, there is provided a machine for filling capsules with a product, as claimed in the attached Claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
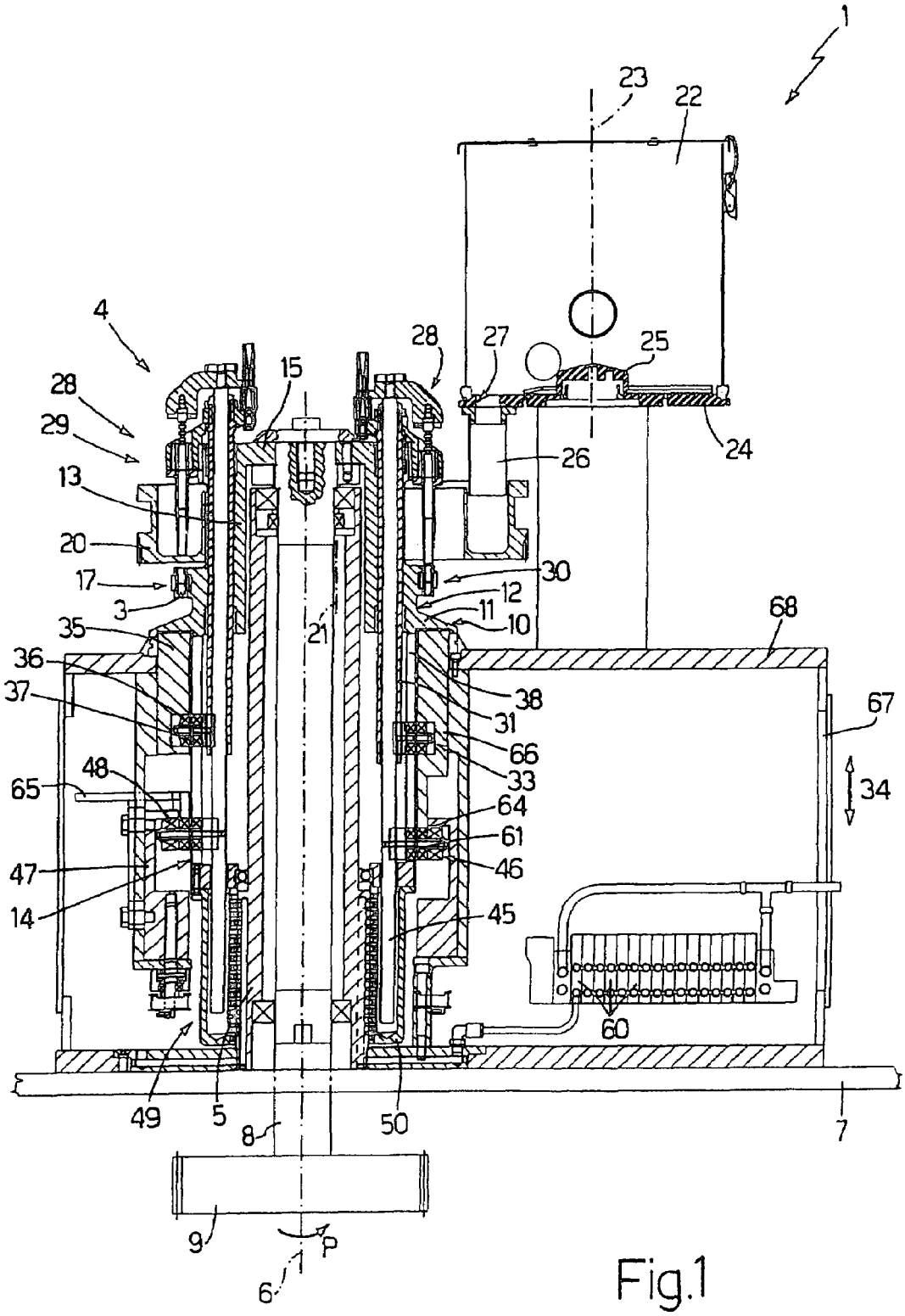
FIG. 1 shows a schematic side view, partly sectioned and with parts removed for clarity, of a preferred embodiment of the machine according to the present invention.
Figure 2:
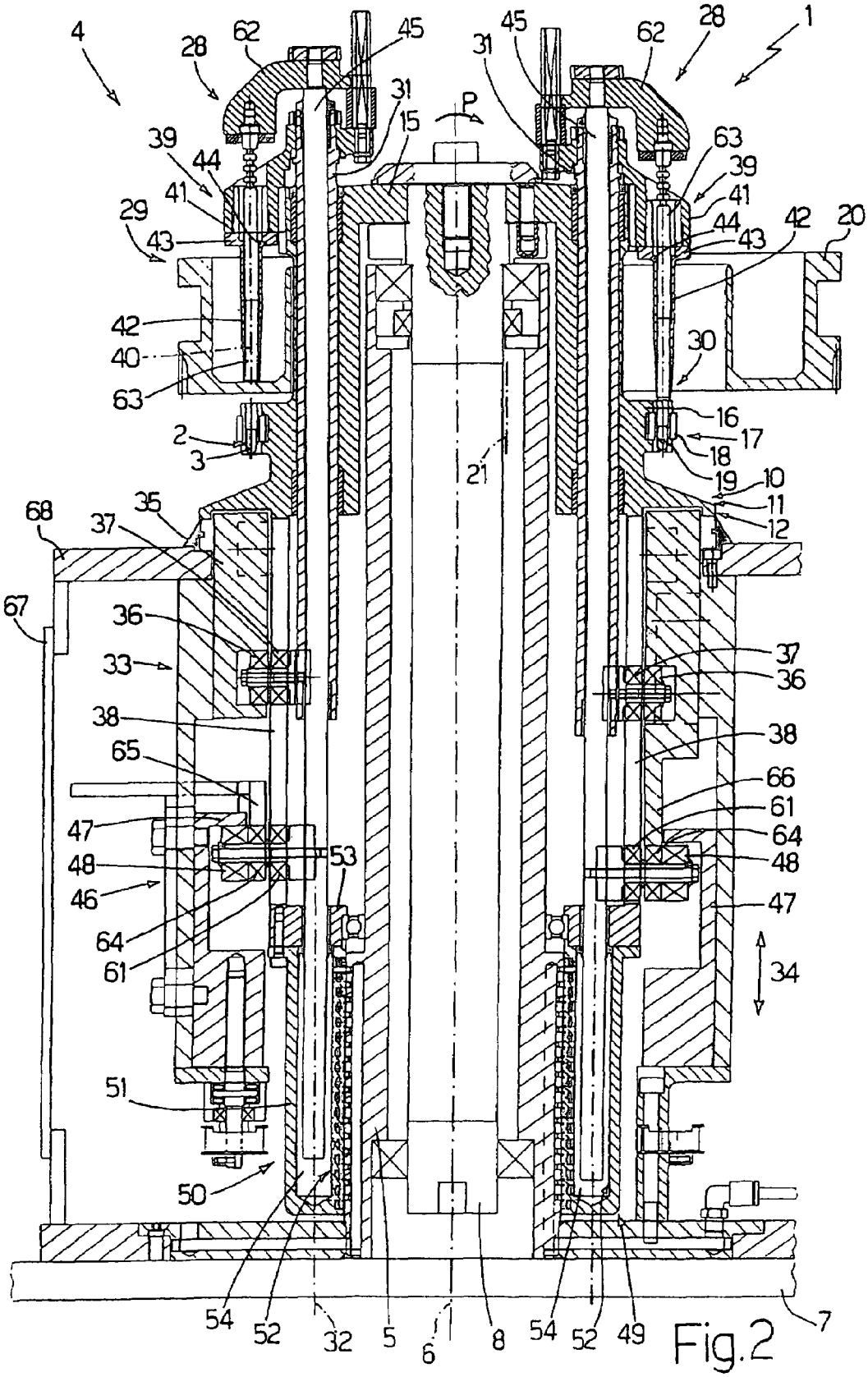
FIG. 2 shows a schematic longitudinal section of a detail of the FIG. 1 machine.

Number 1 in FIGS. 1 and 2 indicates as a whole a machine for filling known capsules 2 with a powdered pharmaceutical product. Each capsule 2 comprises a substantially cup-shaped bottom shell 3, and a top shell (not shown) fitted to bottom shell 3.

Machine 1 comprises a metering wheel 4, in turn comprising a tubular vertical upright 5, which has a longitudinal axis 6, extends upwards from a fixed frame 7 of machine 1, and is engaged by a shaft 8, which extends inside upright 5, coaxially with axis 6, and is connected in rotary manner to upright 5 to rotate continuously, with respect to upright 5 and under the control of a known actuating device 9, about axis 6.

Shaft 8 supports a feed drum 10 comprising a substantially cylindrical casing 11, which is coaxial with axis 6, is positioned with its concavity facing downwards, is bounded laterally by a wall 12 extending about upright 5 and comprising a narrow top portion 13 and a wide bottom portion 14, and is closed at one end by an end wall 15, which is substantially perpendicular to axis 6 and fixed to one end of shaft 8 projecting outwards of upright 5.

A sprocket 16 is formed on the outer surface of portion 13, is coaxial with axis 6, and forms part of a known conveying device 17 for feeding each bottom shell 3 along a given path P. Device 17 comprises a chain conveyor 18, which is looped about a number of sprockets (of which only sprocket 16 is shown in FIGS. 1 and 2) driven by device 9, and has a number of pockets 19, which are substantially cup-shaped with their concavity facing upwards, are equally spaced along conveyor 18, each receive a respective bottom shell 3 with its concavity facing upwards, and are fed continuously along path P by conveyor 18.

Wheel 4 also comprises an annular container 20 containing the powdered pharmaceutical product, and which extends over sprocket 16 and is fitted in rotary manner to frame 7 to rotate continuously, with respect to frame 7 and under the control of a known actuating device not shown, about a respective longitudinal axis 21 parallel to axis 6, and at an angular speed substantially differing from the angular speed of drum 10 and, therefore, of sprocket 16.

The powdered pharmaceutical product is fed into container 20 by a known hopper 22, which has a longitudinal axis 23 parallel to axes 6 and 21, is bounded at the bottom by an end wall 24 perpendicular to axis 23, houses a known mixing device 25 for mixing the pharmaceutical product, and has a feed conduit 26 extending downwards from hopper 22, projecting inside container 20, and fixed to hopper 22 at an opening 27 formed through wall 24 and parallel to axis 23.

Drum 10 has a number of metering devices 28 equally spaced about axis 6 and fed continuously about axis 6 by drum 10. Each device 28 is conveyed by drum 10 in time with a relative pocket 19 along a portion of path P extending between a pickup station 29, where device 28 withdraws a given quantity of pharmaceutical product from container 20, and a filling station 30, where device 28 feeds the withdrawn pharmaceutical product into relative bottom shell 3.

Each device 28 comprises a substantially cylindrical sleeve 31, which has a longitudinal axis 32 substantially parallel to axis 6, extends through portion 13 of drum 10, and is connected in axially-sliding manner to drum 10 to perform, with respect to drum 10 and under the control of an actuating device 33, straight movements in a direction 34 parallel to axes 6 and 32. Device 33 comprises a cam 35 common to sleeves 31 of all the metering devices 28; and a tappet roller 36 carried by sleeve 31 and engaging cam 35.

Sleeve 31 is also connected in angularly-fixed manner to drum 10 by a tappet roller 37, which is carried by sleeve 31 and engages a relative slot 38, formed through portion 14 and parallel to direction 34, to prevent rotation of sleeve 31 about axis 32.

A cylinder 39 is fixed to the top end of sleeve 31, has a longitudinal axis 40 substantially parallel to axes 32, and comprises a wide top portion 41 and a narrow bottom portion 42 connected to each other at a shoulder 43, which is perpendicular to axis 40 and through which is formed at least one opening 44.

Device 28 also comprises a shaft 45, which is fitted inside sleeve 31, coaxially with axis 32, projects outwards of sleeve 31, and is connected in axially-sliding manner to sleeve 31 to perform, with respect to sleeve 31 and under the control of an actuating device 46, straight movements in direction 34.

Device 46 comprises a cam 47 common to shafts 45 of all the metering devices 28; and a tappet roller 48, which is fitted to shaft 45, is smaller in diameter than the width of cam 47 measured parallel to direction 34, and is maintained contacting a top wall of cam 47 by a pneumatic push device 49 for pushing shafts 45 upwards in direction 34.

Figure 3:
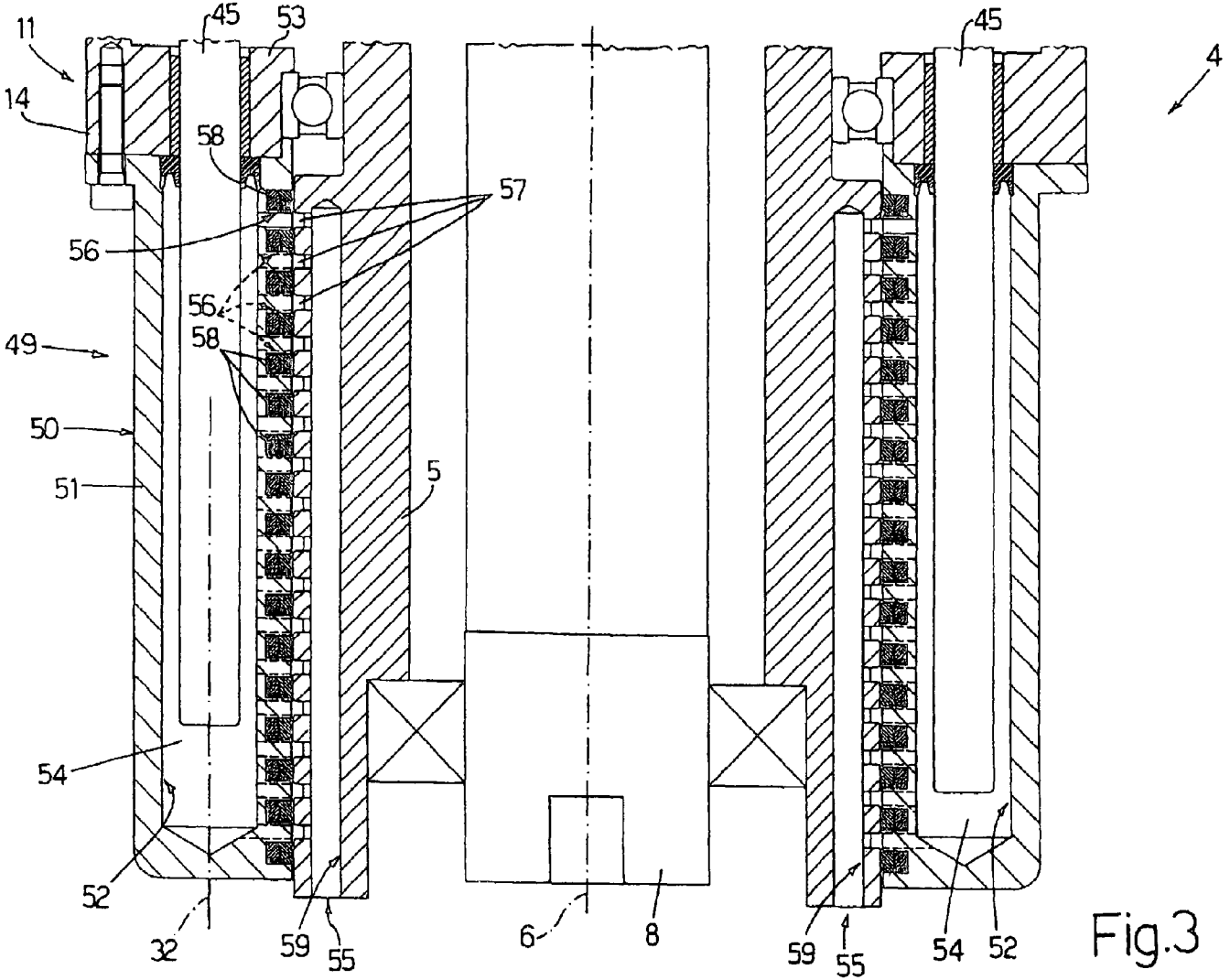
FIG. 3 shows a schematic longitudinal section of a detail of FIG. 2.

As shown in FIG. 3, device 49 comprises a substantially cylindrical casing 50, which is coaxial with axis 6, is fixed, with its concavity facing upwards, to the bottom end of casing 11, and is bounded laterally by a wall 51 extending about upright 5.

Casing 50 comprises a number of cavities 52, which are equal in number to metering devices 28, are equally spaced about axis 6 with the same spacing as devices 28, are formed in wall 51, parallel to direction 34, and are closed at the top by an annular flange 53 projecting radially inwards from the inner surface of drum 10 to define respective pneumatic chambers 54.

Each chamber 54 is engaged in sliding manner by the bottom end of a relative shaft 45, and communicates pneumatically with a known compressed-air pneumatic device (not shown) by means of a relative pneumatic circuit 55. Circuit 55 comprises a radial conduit 56 formed through wall 51; an annular manifold 57 formed on the outer surface of upright 5, coaxially with axis 6, and connected in fluidtight manner to conduit 56 by two annular seals 58 fitted to the inner surface of wall 51, coaxially with axis 6; and an axial conduit 59 formed in drum 10, parallel to direction 34, and connected to said compressed-air pneumatic device (not shown) with the interposition of a solenoid valve 60.

Given that:

conduits 59 are equally spaced about axis 6, and each differ in length, measured parallel to direction 34, from the other conduits 59; and manifolds 57 are aligned with one another in direction 34;

circuits 55 are completely independent of one another, and are connectable selectively to said compressed-air pneumatic device (not shown) by relative solenoid valves 60.

Each shaft 45 is connected in angularly-fixed manner to drum 10 by a tappet roller 61 carried by shaft 45 and engaging relative slot 38 to prevent rotation of shaft 45 about axis 32.

With the interposition of a supporting bracket 62, a substantially cylindrical piston 63 is fixed to the top end of shaft 45, projects downwards from bracket 62, engages relative cylinder 39 in sliding manner, and has a diameter approximately equal to but no larger than the diameter of narrow bottom portion 42 of cylinder 39.

Figure 4:
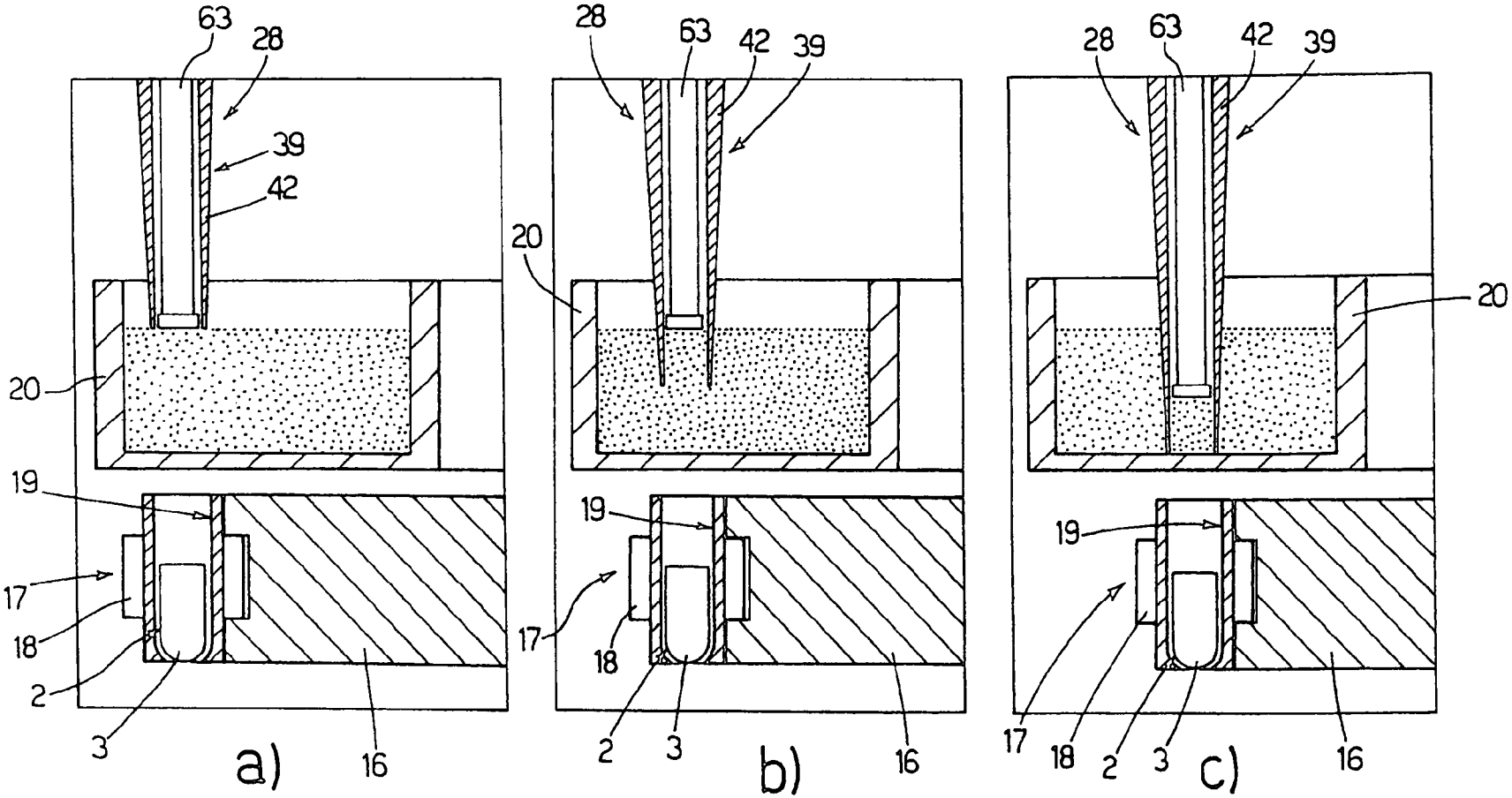
FIG. 4 shows schematically the operating principle of the FIG. 1 machine.
Figure 4:
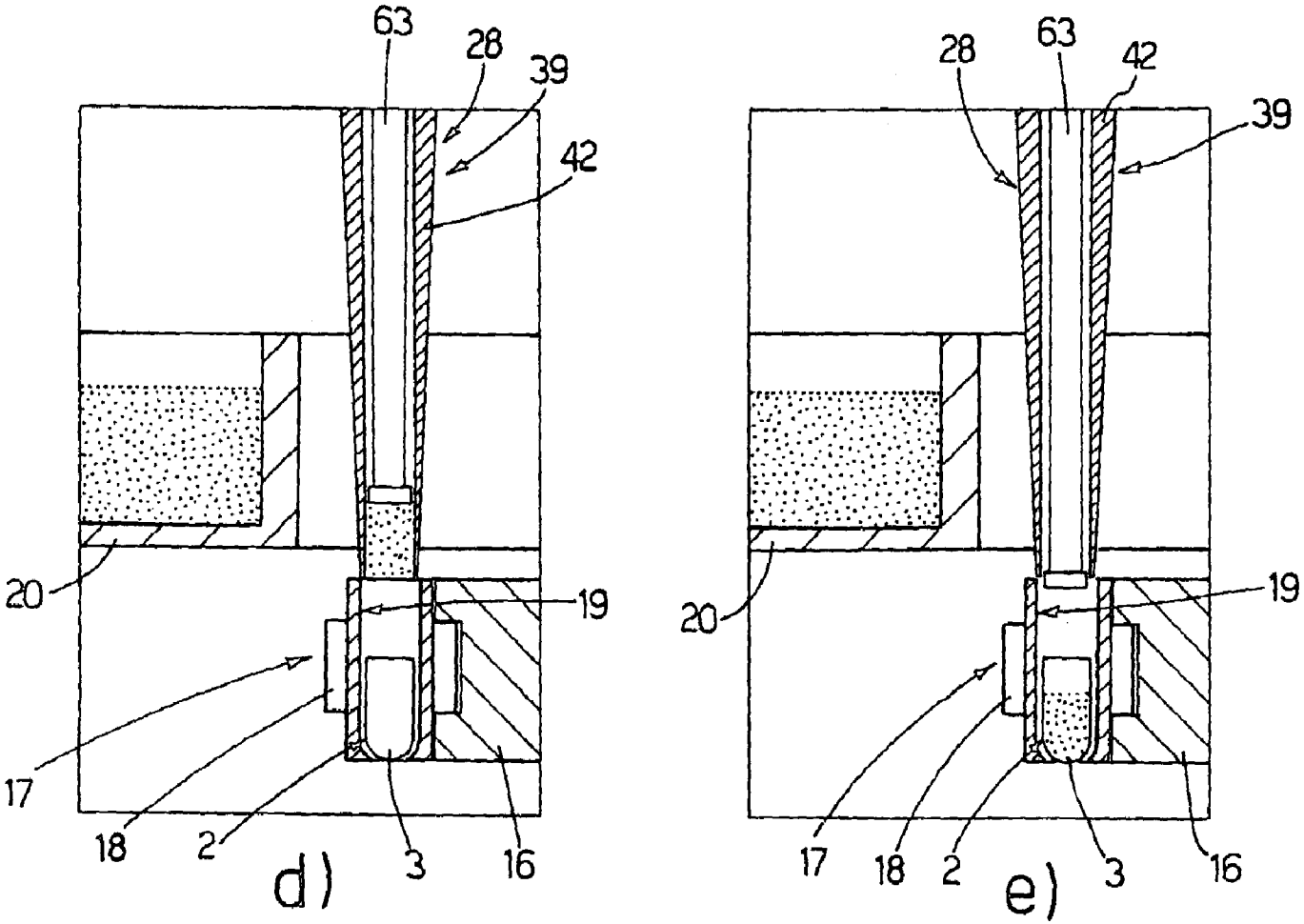

Operation of machine 1 will now be described with reference to FIGS. 2 and 4 and the filling of one bottom shell 3, and as of the instant in which the bottom shell 3 considered and the relative metering device 28 have been fed in time with each other into pickup station 29 (FIGS. 2 and 4*a*), and device 28 is positioned facing container 20.

At station 29, cylinder 39 and piston 63 of metering device 28 considered are first lowered in direction 34 by respective cams 35 and 47 into contact with the top surface of the product inside container 20 (FIG. 4*a*); piston 63 is then maintained contacting the top surface of the product by means of a further cam (not shown) projecting beneath cam 47 and engaged by a tappet roller 64 carried by shaft 45 (FIGS. 4*a* and 4*b*), while cylinder 39 is lowered into the product by cam 35 to define the correct amount of product to be withdrawn (FIG. 4*b*); cylinder 39 and piston 63 are again lowered by respective cams 35 and 47 in time with each other, so as to move cylinder 39 into contact with container 20 (FIG. 4*c*); and piston 63 is lowered further, to compact the product contained between cylinder 39 and piston 63 (FIG. 4*c*), by a cam 65 projecting beneath can 47 and engaged by roller 64.

At this point, by combining the movement of device 28 about axis 6 with the movement of cylinder 39 and piston 63 in direction 34, device 28 is disengaged from container 20 and fed to filling station 30 where, container 20 being mounted eccentrically with respect to drum 10, cylinder 39 and piston 63 are positioned facing relative pocket 19 (FIG. 4*d*).

Finally, piston 63 is lowered, to discharge the withdrawn product into relative bottom shell 3 (FIG. 4*e*), by a cam 66 projecting beneath cam 47 and engaged by roller 64.

Actuating devices 33 of sleeves 31, and actuating devices 46 of shafts 45, i.e. cams 35, 47, 65, 66, the cam (not shown) mounted at pickup station 29 to keep piston 63 in contact with the top surface of the product (FIGS. 4*a* and 4*b*), tappet rollers 36, 37, 48, 61, 64, and push device 49, are housed in a casing 67, which is fitted to frame 7 of machine 1, beneath container 20, is substantially parallelepiped-shaped, is bounded at the top by a wall 68 perpendicular to axis 6, and through which upright 5, shaft 8, and drum 10 project outwards of casing 67, and also houses solenoid valves 60 and said actuating device (not shown) of container 20.

Actuating devices 33, 46 being housed inside casing 67, the powdered pharmaceutical product scattered about metering wheel 4 may therefore be stabilized easily at the end of each operating cycle of machine 1, thus permitting troublefree cleaning and maintenance of machine 1.

Machine 1 also has the further advantage of pneumatic push device 49 enabling selective control of the operation of each metering device 28. More specifically, when a solenoid valve 60 disconnects pneumatic circuit 55 of relative metering device 28 from said compressed-air pneumatic device (not shown), relative piston 63 remains by force of gravity in a lowered position completely closing the narrow bottom portion 42 of relative cylinder 39.

In this way, each metering device 28 can be prevented from withdrawing the product from container 20 when:

the metering device 28 is fed through pickup station 29 in time with a pocket 19 having no bottom shell 3; and machine 1 is started up to feed the product into container 20, and pockets 19 have no bottom shells 3.

In connection with the above, it should be pointed out that the downward gravitational thrust exerted on pistons 63 may be increased by selectively connecting relative circuits 55, by means of relative solenoid valves 60, to a known pneumatic suction device not shown.

In a variation not shown, solenoid valves 60 are eliminated, and chambers 54 are connected permanently to said compressed-air pneumatic device (not shown). In which case, the narrow bottom portion 42 of each cylinder 39 is closed, to prevent withdrawal of the product from container 20 in the aforementioned situations, by two deflecting cams, which are mounted at pickup station 29, and are inserted selectively along the paths of respective tappet rollers 36 and 48 in lieu of respective cams 35 and 47. The deflecting cams are designed to keep each piston 63 in the lowered position closing the narrow bottom portion 42 of relative cylinder 39, and, at pickup station 29, to move piston 63 and relative cylinder 39 over container 20 to prevent withdrawal of the product from container 20.

The invention claimed is:

1. A machine for filling containers (3) with a product, the machine comprising conveying means (17) for feeding each container (3) continuously along a given path (P); a tank (20) containing the product; at least one metering wheel (4) mounted to rotate continuously about a respective longitudinal axis (6); a number of metering devices (28), which are movable with the metering wheel (4) along a portion of said path (P) in time with said containers (3) to feed the product inside the containers (3), and each comprise a respective cylinder (39) and a respective piston (63) movable with respect to each other in a given direction (34); and actuating means (46) for moving the pistons (63) in said direction (34); the actuating means (46) comprising at least one cam (47), at least one tappet (48) for each piston (63) and cooperating with said cam (47) to move the piston (63) in said direction (34), and push means (49) for maintaining said tappets (48) in contact with the cam (47); and the machine being characterized in that said push means (49) are pneumatic push means.

2. A machine as claimed in claim 1, wherein the pneumatic push means (49) comprise a compressed-air source; a pneumatic circuit (54, 55) for each metering device (28) and connectable to the compressed-air source to maintain said tappet (48) in contact with said cam (47); and control means (60) for selectively connecting said pneumatic circuits (54, 55) to said compressed-air source.

3. A machine as claimed in claim 2, wherein the metering wheel (4) comprises a fixed supporting upright (5), and a rotary drum (10) fitted in rotary manner to the supporting upright (5); each pneumatic circuit (54, 55) comprising a chamber (54) formed in the rotary drum (10) and engaged in sliding manner by a supporting shaft (45) supporting the piston (63) of the relative metering device (28); an annular manifold (57) formed in the fixed supporting upright (5), coaxially with said axis (6), and connected pneumatically to the chamber (54); and a conduit (59), which is formed in the fixed supporting upright (5), is connected pneumatically to the annular manifold (57), and is connectable to said compressed-air source.

4. A machine as claimed in claim 3, wherein each said annular manifolds (57) is aligned with one another in said direction (34); each conduit (59) differing in length from the other conduits (59), so as to only communicate pneumatically with the relative said annular manifold (57).

5. A machine as claimed in claim 2, and also comprising a suction device connectable to said pneumatic circuits (54, 55); the control means (60) selectively connecting each pneumatic circuit (54, 55) to the compressed-air source and to the suction device.

6. A machine as claimed in claim 1, and also comprising a casing (67) located beneath said tank (20) to house said actuating means (46).

7. A machine for filling containers (3) with a product, the machine comprising conveying means (17) for feeding each container (3) continuously along a given path (P); a tank (20) containing the product; at least one metering wheel (4) mounted to rotate continuously about a respective longitudinal axis (6); at least one metering device (28), which is movable with the metering wheel (4) along a portion of said path (P) in time with said container (3) to feed the product inside the container (3), and comprises a cylinder (39) and a piston (63) movable with respect to each other in a given direction (34); and actuating means (33, 46) for moving the cylinder (39) and the piston (63) with respect to each other in said direction (34); and the machine being characterized by also comprising a casing (67) located beneath said tank (20) to house said actuating means (33, 46).

8. A machine as claimed in claim 7, wherein said actuating means (33, 46) comprise cam means (47, 65, 66) for moving the piston (63) in said direction (34).

9. A machine as claimed in claim 8, wherein said cam means (47, 65, 66) comprise at least one cam (47), and at least one tappet (48) cooperating with said cam (47) to move the piston (63) in said direction (34); push means (49) being provided to maintain said tappet (48) in contact with said cam (47).

10. A machine as claimed in claim 9, wherein said push means (49) are housed in said casing (67).

11. A machine as claimed in claim 9, wherein said push means (49) are pneumatic push means (49).

12. A machine as claimed in claim 9, and comprising a number of said metering devices (28); said push means (49) comprising a compressed-air source; a pneumatic circuit (54, 55) for each metering device (28) and connectable to the compressed-air source to maintain said tappet (48) in contact with said cam (47); and control means (60) for selectively connecting said pneumatic circuits (54, 55) to said compressed-air source.

13. A machine as claimed in claim 12, wherein the metering wheel (4) comprises a fixed supporting upright (5), and a rotary drum (10) fitted in rotary manner to the supporting upright (5); each pneumatic circuit (54, 55) comprising a chamber (54) formed in the rotary drum (10) and engaged in sliding manner by a supporting shaft (45) supporting the piston (63) of the relative metering device (28); an annular manifold (57) formed in the fixed supporting upright (5), coaxially with said axis (6), and connected pneumatically to the chamber (54); and a conduit (59), which is formed in the fixed supporting upright (5), is connected pneumatically to the annular manifold (57), and is connectable to said compressed-air source.

14. A machine as claimed in claim 13, wherein said annular manifolds (57) are aligned with one another in said direction (34); each conduit (59) differing in length from the other conduits (59), so as to only communicate pneumatically with said annular manifold (57).

15. A machine as claimed in claim 12, and also comprising a suction device connectable to said pneumatic circuits (54, 55); the control means (60) selectively connecting each pneumatic circuit (54, 55) to the compressed-air source and to the suction device.

* * * * *